United States Patent [19]

Bose

[11] 4,107,461

[45] Aug. 15, 1978

[54] ENVIRONMENT FOR DEMONSTRATING A STEREO LOUDSPEAKER SYSTEM

[75] Inventor: Amar G. Bose, Wayland, Mass.

[73] Assignee: Bose Corporation, Framingham, Mass.

[21] Appl. No.: 804,896

[22] Filed: Jun. 9, 1977

[51] Int. Cl.[2] ..... H04R 5/02

[52] U.S. Cl. ..... 179/1 GA

[58] Field of Search ..... 179/1 GA, 183

[56] References Cited

U.S. PATENT DOCUMENTS

| | | | |
|---|---|---|---|
| 2,804,933 | 9/1957 | Imhof | 179/100 H R |
| 3,144,513 | 8/1964 | Sherron | 179/183 |
| 3,237,713 | 3/1966 | Leslie | 179/183 |

FOREIGN PATENT DOCUMENTS

| | | | |
|---|---|---|---|
| 1,132,378 | 10/1968 | United Kingdom | 179/183 |

OTHER PUBLICATIONS

Bell Laboratories Record, Jun./Jul. 1972, pp. 175 & 179 from "Diversity in Public Telephone Enclosures", K.D. Bartley.

*Primary Examiner*—George G. Stellar
*Attorney, Agent, or Firm*—Charles Hieken

[57] ABSTRACT

A generally semicircular enclosure about 3 feet in radius and 7.5 feet high carries a pair of horizontally mounted loudspeakers centered about 5.5 feet from the bottom facing the center of the enclosure.

5 Claims, 2 Drawing Figures

ENVIRONMENT FOR DEMONSTRATING A STEREO LOUDSPEAKER SYSTEM

BACKGROUND OF THE INVENTION

The present invention relates in general to controlling acoustic environment and more particularly concerns novel apparatus and techniques for providing a good localized listening environment in a larger region while reducing the sound energy outside the enclosure.

The sound quality of a loudspeaker system is a function of its environment. Many retail dealers who sell a wide variety of products are reluctant to provide an acoustic environment that enables a potential purchaser to hear a loudspeaker under conditions that enable the listener to reasonably determine the quality of the sound. This evaluation often requires listening at sound levels that may be disturbing to other customers and/or sales personnel in the selling area.

Accordingly, it is an important object of the invention to provide an improved acoustic environment for a loudspeaker system.

It is another object of the invention to achieve the preceding object with structure that facilitates listening to a loudspeaker system at reasonable sound levels by one person in a larger selling area while reducing the sound projected outside the structure.

It is a further object of the invention to achieve one or more of the preceding objects with structure that is relatively inexpensive and compact.

It is a further object of the invention to achieve one or more of the preceding objects with an open structure that facilitates rapid entry into and egress from the enclosure.

SUMMARY OF THE INVENTION

According to the invention, a partial cylindrical structure having a span greater than that of two horizontally positioned loudspeaker cabinets and a height greater than that of the average adult human being carries first and second spaced horizontally aligned loudspeakers facing the center of the enclosure substantially at ear height of a listener. Typically the enclosure is generally semicylindrical about 3 feet in radius and more than 6 feet high with horizontally aligned loudspeaker cabinets attached to the inside wall of the enclosure and separated by about 3 feet, the radius and height being less than and greater than the height of a person, respectively.

Numerous other features, objects and advantages of the invention will become apparent from the following specification when read in connection with the accompanying drawing in which:

DETAILED DESCRIPTION OF PREFERRED EMBODIMENTS

Figure 1:
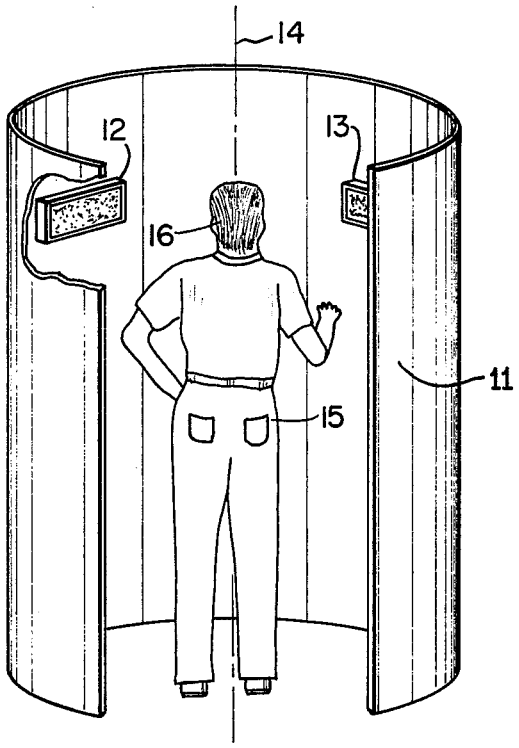
FIG. 1 is a perspective view of a preferred embodiment according to the invention.

With reference now to the drawing and more particularly FIG. 1 thereof, there is shown a semicylindrical enclosure 11 having mounted thereto left and right horizontally mounted loudspeaker cabinets 12 and 13, respectively, pointed toward the center line 14 embraced by a listener 15 with loudspeakers 12 and 13 mounted substantially at the height of the head 16 of the listener. Typically the radius of enclosure 11 is 3 feet and its height 7.5 feet, and a cylindrical top (not shown) may cover it. Enclosure 11 may also carry a receiver and/or record player or other program source. Loudspeakers 12 and 13 are preferably mounted with the outermost corner of each substantially touching a chord joining the edges of enclosure 11 when the angle subtended by the chord is substantially 161° and spaced by a distance greater than the radius, the spacing typically being about 4 feet.

The result of this arrangement is that enclosure 11 may be placed in a larger display area to provide easy access to listener 15 while directing the sound at reasonable sound levels to listener 15 and providing listener 15 with a good environment for stereo listening. At the same time the sound level outside enclosure 11 from loudspeakers 12 and 13 is sufficiently low to minimize disturbances to others in the larger sales area.

In a preferred form of the invention enclosure 11 embraces slightly less than 180°, typically 161° and may be greater to further confine the sound inside the enclosure, the opening being preferably at least wide enough so that a person may easily enter.

Figure 2:
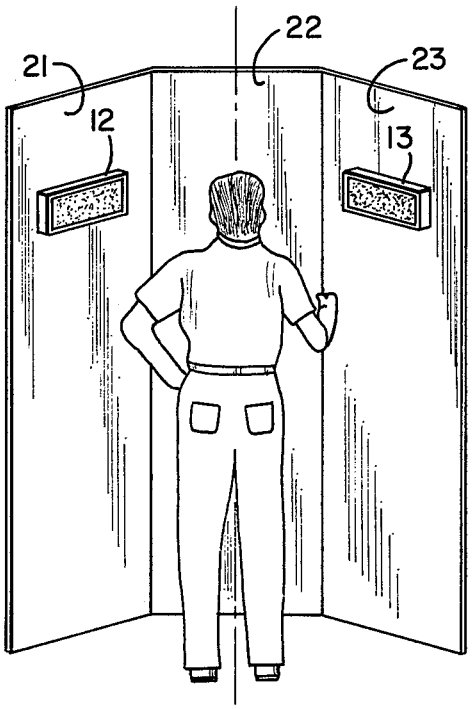
FIG. 2 is a perspective view of an alternate embodiment of the invention.

Referring to FIG. 2, there is shown a perspective view of an alternate embodiment of the invention comprising three panels 21, 22 and 23 in an inscribed semicircular cylinder carrying loudspeakers 12 and 13 again at head height. This embodiment of the invention may include fourth and fifth panels (not shown) attached to panels 21 and 23 directed inward for helping to confine the sound inside the enclosure while still leaving an opening wide enough for a person to easily enter.

In an actual embodiment of the invention in which loudspeakers 12 and 13 conform substantially to BOSE Model 301 loudspeakers; the enclosure of FIG. 1 provides a good acoustic environment allowing a listener to hear good stereo sound at high listening levels with sound quality improved by having the deflecting vane oriented so as to direct the sound from the tweeter on the angled panel part to the inside of the enclosure. At the same time the level outside the enclosure is considerably less than that inside the enclosure.

It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A loudspeaker system environment for demonstrating a stereo loudspeaker system to a single individual inside said environment without appreciably disturbing others outside said environment comprising, first and second loudspeaker systems comprising said stereo loudspeaker system, means defining an acoustic enclosure for supporting said first and second loudspeaker cabinets at a height corresponding substantially to the head of a listener and pointing toward the axis of said enclosure, said enclosure having a span greater than the span of said first and second loudspeaker systems and sufficiently great to accommodate a person on said axis with its perimeter embracing at least substantially slightly less than a semicircle and embracing sufficiently less than a circle to provide an opening greater than the width of a person for providing easy entry to a person while providing good stereo sound reception along said axis at said head height while providing significantly less sound intensity outside said enclosure, the separation between outermost portions of said first and second loudspeaker systems being greater than the radius of said semicircle and said first and second loudspeaker systems being substantially inside said semicircle.

2. A loudspeaker system environment in accordance with claim 1 wherein said enclosure is substantially semicircular.

3. A loudspeaker system environment in accordance with claim 1 wherein said enclosure comprises a plurality of flat panels within an inscribed portion of a cylinder.

4. A loudspeaker environment in accordance with claim 2 wherein the radius of said semicircle is substantially three feet, the height of said enclosure is substantially 7.5 feet and said enclosure subtends an angle of substantially 161°.

5. A loudspeaker system environment in accordance with claim 2 wherein the radius of said enclosure is less than the height of a person.

* * * * *